United States Patent [19]

Dalia

[11] 4,270,313

[45] Jun. 2, 1981

[54] LOUVER LOCK

[76] Inventor: Salvatore A. Dalia, 2125 W. 234th St., Torrance, Calif. 90501

[21] Appl. No.: 70,912

[22] Filed: Aug. 29, 1979

[51] Int. Cl.[3] ..... E06B 7/08

[52] U.S. Cl. ..... 49/403

[58] Field of Search ..... 49/403, 74–92

[56] References Cited

U.S. PATENT DOCUMENTS

| | | | |
|---|---|---|---|
| 2,981,987 | 5/1961 | Schwab | 49/403 X |
| 3,161,268 | 12/1964 | Bent | 49/403 |
| 3,903,649 | 9/1975 | Dalia | 49/403 |
| 4,027,430 | 6/1977 | Sakamoto | 49/403 |

*Primary Examiner*—Philip C. Kannan
*Attorney, Agent, or Firm*—Howard L. Johnson

[57] ABSTRACT

A liner (interchangeable) for each end bracket of a louver assembly, the liner consisting of a flat strip with longitudinal edge abutment and U-bent at each end to embrace the end margins of the louver pane or panel, with either inturned U-arm disposed to transversely receive a resilient U-shaped retainer jointly embracing the respective arm and adjacent bracket wall, with contact anchorage means carried on both the bent arm and retainer so as to jointly prevent external displacement of the liner (and its embraced louver panel) from the end brackets.

6 Claims, 11 Drawing Figures

LOUVER LOCK

BACKGROUND

Louver windows and doors have long proved an easy way to obtain illicit entry into a building with little effort and noise. Thus, in the absence of a restraining element, a single pane or panel might be pushed up with its end brackets until it could be lifted out of place, and then by an arm inserted through the opening thus formed, other panels easily removed and/or the door latch thus manipulated from the outside. In my U.S. Pat. No. 3,903,649, I disclosed a security clip or liner which could be mounted, one on each end of a louver panel, and snugly lodged (permanently) within the corresponding pair of end brackets of the assembly so as to resist external efforts to dislodge it. The present invention provides a modification of such liners so that they can now be mounted interchangeably on either end of the panel (i.e. do not have to be supplied as right-end and left-end forms) and in addition provides positive locking means for transversely directed anchorage of the liner with the bracket and both of them with a retainer element. When thus locked, the panel is resistant to upward displacement even by repeated hammer blows directed against its lower outer edge.

SUMMARY OF THE INVENTION

For such jalousie or louver assembly, the invention provides a bisymmetrical liner (when viewing its length) having a U-bent arm at each end (top and bottom ends when disposed vertically) and a panel-edge abutment ledge located along one longitudinal (vertical) margin intermediate the pair of U-bends. Such liners can thus be mounted one on each end of a (horizontal louver panel, and each liner-carrying-end then inserted within an end-bracket of the jalousie with the upper inturned U-arm outwardly overlying the adjacent bracket arm (see FIG. 1). The juxtaposed pair of bracket arm and liner arm are then locked together by a separate U-shaped resilient retainer, having an inturned tang or barb (which anchors in the softer bracket metal) which in response to transverse sliding movement across the thus grasped arms, fastens together (a) the downturned U-arm to the underlying bracket arm, and (b) the slide-retainer element to the bracket arm. The former effect results in part from detent elements (i.e. raised surface spot barriers) formed in each of the overlying U-arms (thus making them interchangeable), which for the upper U-arm provides an abutment against down vertical displacement of the retainer-clip along the U-arm, and for the lower U-arm provides an abutment against the dependent retention tab of the bracket.

DETAILED DESCRIPTION OF PREFERRED EMBODIMENT

Figure 8:
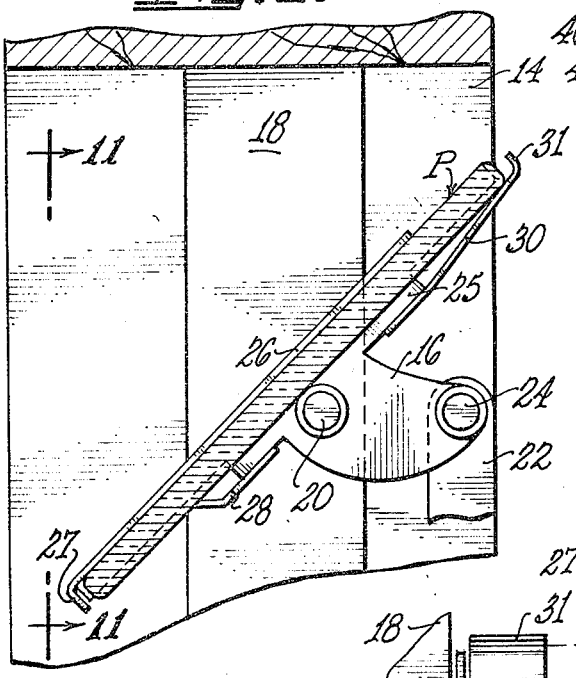
FIG. 8 is a vertical section through the louver panel held in a conventional mounting bracket, in open position and without the present liner and retainer assembly.

The conventional jalousie installation provides a generally rectangular opening 14 in a door or structural wall, with a vertically separated series of operating brackets 16, each attached to the casing side wall 18 by a hanging pivot mounting 20, being tiltable in unison by upright movement of a rod 22 which is pivoted to each bracket at 24. The flat bracket surface extends in both directions to form an end wall 25 which at its outer edge joins an L-shaped support wall 26, the bottom ledge 27 of which supports a louver panel P. Along the inner face of the panel, the bracket structure forms a dependent retention tab 28 which is disposed to abut the lower portion of the panel, and an upper retention arm 30 having a transverse edge 31 extends upward so as to overlie the top panel edge (FIG. 8). The panel mounting unit which is (horizontally) at the opposite side of the opening 14 is essentially the same except for lacking the bracket arm 16 and operating rod 22. it is attached by a pivot, horizontally aligned with the operating-rod-connected pivot (20).

Such basic jalousie construction is very satisfactory for opening and closing the louvers, as shown by its wide usage, especially in hot and humid climates. However, as noted before, when placed as the sole barrier to a human intruder, the latter can rather readily circumvent the barrier simply by upwardly displacing a panel from the bracket assembly, especially with the panel usually being loose and the bracket elements (30, 31) being bendable when forced. Once a panel is removed (by breakage if necessary) an intruder can reach in and quickly remove the other panels if loose.

Figure 1:
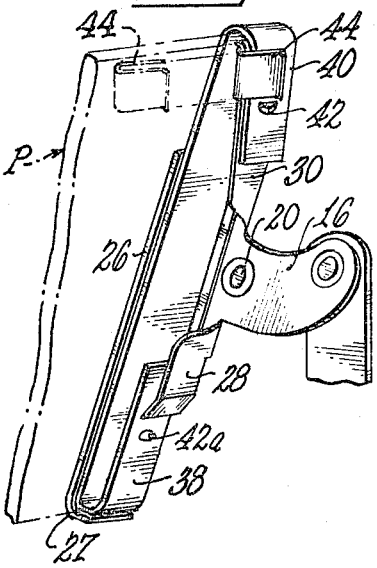
FIG. 1 is a perspective view of a jalousie end bracket holding one end of a louver panel (in phantom) with the present liner and retainer assembly mounted thereon. A detached retainer clip is also shown to the left to illustrate its pre-attachment position.
Figure 2:
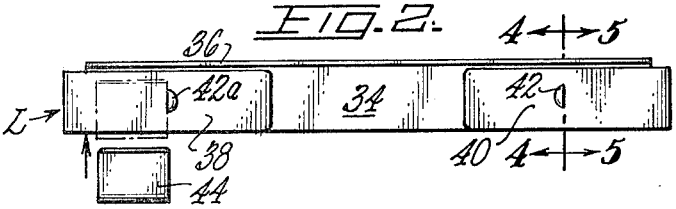
FIG. 2 is a top plan view of the liner and (detached) retainer.
Figure 3:
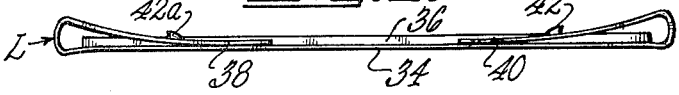
FIG. 3 is a longitudinal edge elevational view of the liner with the resilient arms shown frictionally pressing against the longitudinal strip of the liner.
Figure 4:
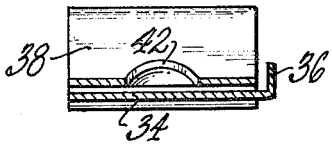
FIGS. 4 and 5 are transverse sectional views of the liner taken along the respective lines 4—4 and 5—5 of FIG. 2.
Figure 5:
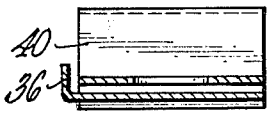
Figure 6:
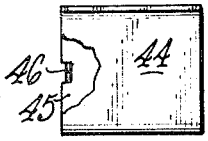
FIG. 6 is a plan view of the retainer with a portion of its upper arm broken away to shown the edge-barb.
Figure 7:
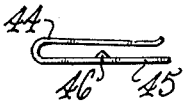
FIG. 7 is an elevational view of the retainer seen from the right of FIG. 6.

Accordingly the present invention provides a liner or security clip L (FIGS. 2–3) which is attachable one to each end of each panel, which are then both disposed within the respective end brackets. The liner is formed with a flat length 34 approximately equal to the vertical height of a panel P, with a lengthwise edge abutment lip 36 located along the edge which is "outside" when in use. Each end of the stainless steel (resilient) strip is turned back like a "U" to form a pair of arms 38, 40 which overlie a portion of the length 34 and when the length is mounted on a panel, they engage or press against its inner face. Intermediate its length, each arm has an out-punched half-dome or detent 42 (FIG. 4), typically of crescent or half-moon shape. Since the liner is bilaterally symmetrical, it will be apparent that it can be mounted on either end of a louver panel P. The detent 42*a* which is then on the "lower" arm 38 will abut the end of retention tab 28 if an effort is made to displace the panel and liner "upward" within its brackets. Such movement will simultaneously cause the upper detent 42 to edge abut or jam against the retainer clasp 44 (FIG. 1).

Figure 9:
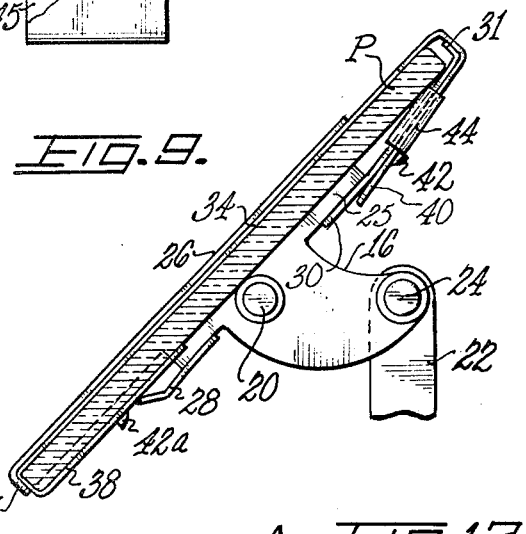
FIG. 9 is a corresponding view with the present liner and retainer installed.
Figure 10:
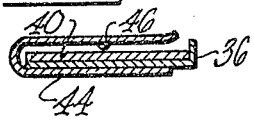
FIG. 10 is a transverse sectional view taken through the assembled retainer, U-arm and bracket arm
Figure 11:
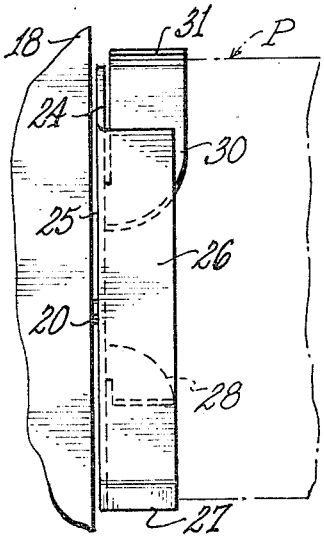
FIG. 11 is an elevational view of the conventional installation of FIG. 8 as viewed along the line 11—11 of FIG. 8.
Figure 12:
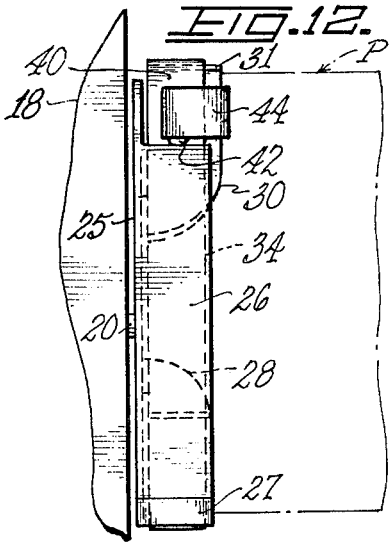
FIG. 12 is a corresponding view to FIG. 11 with the present retainer and liner installed.

A U-shaped retainer clasp 44 formed of spring steel is provided with at least one side edge of its lower arm 45 notched and turned upward to form a spur or barb 46. In use, the liner L is placed on the end of a panel P and the whole is inserted in the end bracket mount 16 with the upper U-arm 40 overlying the transverse edge 31 and retention arm 30 of the bracket assembly (FIGS. 1 and 9). The retention clasp 44 is then moved transversely to clasp and hold together the U-arm 40 and the planar juxtaposed retention arm 30. The barb 46 at this time bites into the softer metal (usually aluminum) of the bracket arm (30) and the panel is thus anchored or resistant to such force (applied to ledge 27) as would try to shove the panel and liner upward out of the bracket(s). Such resistance would also act against any tendency of the U-arm 40 to move upward along (relative to the panel) in a manner which might urge the U elbow of 40 to "unbend" or straighten.

I claim:

1. The combination of a bracket liner and an interengaging retainer for use with a generally rectangular, flatfaced louver panel when such panel is disposed in a jalousie opening by means of a pair of aligned end brackets each positioned to engage opposite faces of the panel along respective end margins thereof said bracket liner comprising an elongated, generally flat strip having a slightly greater length than the height of said panel, with a panel-abutment ledge disposed along an intermediate portion of said length for engagement with an end of the panel, the strip having opposite end segments formed as mutually facing, open, U-shape channels, each with a U-channel arm overlying said flat strip and thus adapted for reception of an edge of the panel there under and subsequent insertion of the panel and end-mounted liners into said end brackets, the upper end of each of said U-channels thus having its inward and downwardly directed U-channel arm disposable in planar juxtaposition with an adjacent surface of said end bracket along an inner side of said jalousie opening and in such position said bracket surface and U-channel arm being jointly disposed to transversely receive lock means comprising a separate retainer clasp for effecting tight engagement of the U-channel arm and the juxtaposed bracket surface.

2. The bracket liner and retainer of claim 1 wherein said retainer is a U-shape clasp formed of resilient steel with inturned prong means disposed to score an adjacent one of said juxtaposed contacted surfaces when slid transversely into locking engagement therewith.

3. The bracket liner and retainer of claim 2 wherein the U-channel arm of each of said opposite end segments of the bracket liner carries detent means located to provide an edge abutment barrier gainst lengthwise displacement therealong respectively of a bracket retention tab and the retainer.

4. The combination comprising a louver panel disposed in a jalousie opening by means of a pair of pivotal end brackets, at least one of which end brackets functionally carries the bracket liner and retainer of claim 1.

5. The combination comprising a louver panel disposed in a jalousie opening by means of a pair of pivotal end brackets, at least one of which end brackets functionally carries the bracket liner and retainer of claim 2.

6. The combination comprising a louver panel disposed in a jalousie opening by means of a pair of pivotal end brackets, at least one of which end brackets functionally carries the bracket liner and retainer of claim 3.

* * * * *

UNITED STATES PATENT OFFICE

CERTIFICATE OF CORRECTION

Patent No. 4,270,313 Dated June 2, 1981

Inventor(s) Salvatore A. Dalia

It is certified that error appears in the above-identified patent and that said Letters Patent are hereby corrected as shown below:

Col. 1, line 9, "with" should be --within--.

Col. 1, line 36, should be close parenthesis after "horizontal.

Col. 2, line 5, "shown" should be --show--.

Col. 2, line 40, "it" should be --It--.

Col. 4, line 24, "gainst" should be --against--.

Signed and Sealed this

First Day of September 1981

[SEAL]

Attest:

GERALD J. MOSSINGHOFF

Attesting Officer

Commissioner of Patents and Trademarks